US010767610B2

(12) United States Patent
Anders et al.

(10) Patent No.: US 10,767,610 B2
(45) Date of Patent: Sep. 8, 2020

(54) LIQUID FUEL INJECTOR HAVING DUAL NOZZLE OUTLET SETS, FUEL SYSTEM, AND METHOD

(71) Applicant: Caterpillar Inc., Deerfield, IL (US)

(72) Inventors: Jonathan W Anders, Peoria, IL (US); Bobby John, Peoria, IL (US); Robert Campion, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 22 days.

(21) Appl. No.: 16/107,199

(22) Filed: Aug. 21, 2018

(65) Prior Publication Data

US 2020/0063704 A1 Feb. 27, 2020

(51) Int. Cl.

| | |
|---|---|
| ***F02M 57/02*** | (2006.01) |
| ***F02M 61/18*** | (2006.01) |
| ***F02M 45/08*** | (2006.01) |
| ***F02M 63/02*** | (2006.01) |

(52) U.S. Cl.

CPC ..... *F02M 45/086* (2013.01); *F02M 57/025* (2013.01); *F02M 61/182* (2013.01); *F02M 63/0225* (2013.01); *F02M 2200/46* (2013.01)

(58) Field of Classification Search

CPC ..... F02M 63/0225; F02M 61/182; F02M 57/025; F02M 45/086; F02M 2200/46

USPC ..... 123/299

See application file for complete search history.

(56) References Cited

U.S. PATENT DOCUMENTS

| | | | | |
|---|---|---|---|---|
| 4,022,165 | A | 5/1977 | Bosch | |
| 6,422,199 | B1 * | 7/2002 | Buckley | F02M 45/086 123/299 |
| 6,769,635 | B2 | 8/2004 | Stewart et al. | |
| 6,889,762 | B2 | 5/2005 | Angelino et al. | |
| 6,945,475 | B2 | 9/2005 | Lawrence et al. | |
| 7,134,615 | B2 | 11/2006 | Lawrence | |
| 7,243,862 | B2 | 7/2007 | Delphi | |
| 7,556,017 | B2 | 7/2009 | Gibson | |
| 9,151,222 | B2 | 10/2015 | Svensson | |
| 9,506,434 | B2 | 11/2016 | Coldren | |
| 9,957,939 | B2 | 5/2018 | Cummins | |
| 2004/0055562 | A1 | 3/2004 | Stewart | |
| 2007/0246561 | A1 * | 10/2007 | Gibson | F02M 45/086 239/5 |
| 2010/0012092 | A1 | 1/2010 | Futonagane et al. | |

(Continued)

FOREIGN PATENT DOCUMENTS

| | | | |
|---|---|---|---|
| CN | 105464865 | B | 11/2017 |
| DE | 10323871 | A1 | 8/2004 |

(Continued)

*Primary Examiner* — Mahmoud Gimie

(74) *Attorney, Agent, or Firm* — Brannon Sowers & Cracraft

(57) ABSTRACT

A liquid fuel injector for a fuel system in an internal combustion engine includes two injection control valves for controlling two outlet checks. A common nozzle supply cavity is fluidly connected to an inlet passage and supplies each of the two sets of nozzle outlets opened and closed by the outlet checks. A first nozzle outlet set forms a narrower spray angle and has a first combination of outlet number and outlet size, and a second nozzle outlet set forms a wider spray angle and has a second combination of outlet number and outlet size. The first nozzle outlet set has a greater steady flow than the second nozzle outlet set.

19 Claims, 5 Drawing Sheets

(56) References Cited

U.S. PATENT DOCUMENTS

| | | | | |
|---|---|---|---|---|
| 2010/0269783 | A1* | 10/2010 | Hergart | F02M 45/086 123/295 |
| 2011/0253094 | A1 | 10/2011 | Rothbauer et al. | |
| 2014/0034023 | A1 | 2/2014 | Coldren | |
| 2014/0061326 | A1 | 3/2014 | Coldren | |
| 2014/0311455 | A1* | 10/2014 | Kim | F02M 43/04 123/472 |
| 2015/0247468 | A1 | 9/2015 | Chittenden | |

FOREIGN PATENT DOCUMENTS

| | | | |
|---|---|---|---|
| JP | 2006152893 | A | 6/2006 |
| JP | 20016152893 | A | 6/2016 |
| WO | 2008088416 | W | 7/2008 |

* cited by examiner

LIQUID FUEL INJECTOR HAVING DUAL NOZZLE OUTLET SETS, FUEL SYSTEM, AND METHOD

TECHNICAL FIELD

The present disclosure relates generally to a liquid fuel injector for a fuel system in an internal combustion engine and relates more particularly to a liquid fuel injector having dual outlet checks and dual nozzle outlets supplied by a common nozzle supply cavity.

BACKGROUND

Fuel systems used in state-of-the-art internal combustion engines are relatively complex and sophisticated electromechanical systems. The associated engines can be direct-injected where fuel injectors extend into the engine cylinders, port-injected where fuel is delivered into a port in communication with an engine cylinder, or structured according to yet another strategy. In the case of compression ignition diesel engines it is typical for liquid fuel injection pressures to be as high as several hundred megapascals (MPa). Injections can occur multiple times per second, necessitating rapid travel of moving parts within the fuel injector in response to electromagnetic actuation forces and/or rapid pressure changes, and resulting in relatively intense, repetitive impacts, and in some instances a tendency toward liquid cavitation. The timing and manner of injection of fuel is typically relatively tightly controlled, with opening and closing of valves desirably quite rapid to produce so-called "square" injection rate shapes, ramp shapes, and still others.

Pressurization of the fuel to be injected can take place within the fuel injector itself, such as by way of a hydraulically actuated or cam-actuated plunger, or externally such that pressurized fuel is stored in a common rail or the like and a reservoir of pressurized fuel maintained for multiple fuel injectors. Due to the foregoing and other factors, fuel injectors are often purpose-built for certain fuel injection strategies and combustion recipes. One example fuel injector for an internal combustion engine is known from U.S. Pat. No. 7,556,017 to Gibson et al.

SUMMARY OF THE INVENTION

In one aspect, a liquid fuel injector for an internal combustion engine includes an injector body defining an inlet passage, a first set of nozzle outlets, a second set of nozzle outlets, a first control chamber, and a second control chamber each in fluid communication with the inlet passage, and a low-pressure space. The liquid fuel injector further includes a first outlet check having a closing hydraulic surface exposed to a fluid pressure of the first control chamber and movable between a closed position blocking the first set of nozzle outlets, and an open position. The liquid fuel injector further includes a second outlet check having a closing hydraulic surface exposed to a fluid pressure of the second control chamber and movable between a closed position blocking the second set of nozzle outlets, and an open position. The liquid fuel injector still further includes a first injection control valve positioned fluidly between the first control chamber and the low-pressure space, and a second injection control valve positioned fluidly between the second control chamber and the low-pressure space. The first set of nozzle outlets form a narrower spray angle and have a first combination of outlet number and outlet size, such that the first set of nozzle outlets produces a relatively greater steady flow of fuel for injection. The second set of nozzle outlets form a wider spray angle and have a second combination of outlet number and outlet size, such that the second set of nozzle outlets produces a relatively lesser steady flow of fuel for injection. The injector body further defines a common nozzle supply cavity in fluid communication with the inlet passage, and the first set of nozzle outlets and the second set of nozzle outlets being in fluid communication with the common nozzle supply cavity at the open position of the first outlet check and the second outlet check, respectively.

In another aspect, a fuel system for an internal combustion engine includes a liquid fuel supply, and a plurality of liquid fuel injectors each defining an inlet passage, a first set of nozzle outlets, a second set of nozzle outlets, and a low-pressure space. The plurality of liquid fuel injectors each include a first direct-operated outlet check movable between a closed position blocking the first set of nozzle outlets, and an open position, and a second direct-operated outlet check movable between a closed position blocking the second set of nozzle outlets and an open position. The plurality of liquid fuel injectors each further include a first injection control valve coupled with the first direct-operated outlet check and a second injection control valve coupled with the second direct-operated outlet check. The first set of nozzle outlets in each one of the plurality of liquid fuel injectors form a narrower spray angle and have a first combination of outlet number and outlet size, such that the first set of nozzle outlets produces a greater steady flow of fuel for injection. The second set of nozzle outlets in each one of the plurality of liquid fuel injectors form a wider spray angle and have a second combination of outlet number and outlet size different from the first combination, such that the second set of nozzle outlets produces a lesser steady flow of fuel for injection.

In still another aspect, a method of operating an engine includes supplying liquid fuel to a liquid fuel injector positioned at least partially within a cylinder in the engine, and injecting a first charge of the liquid fuel into a cylinder in the engine using a first set of nozzle outlets in a fuel injector, such that spray jets of the first charge of the liquid fuel are oriented at a relatively narrower spray angle. The method further includes autoigniting the first charge of the liquid fuel such that the first charge of the liquid fuel combusts by diffusion burning within the cylinder in a first engine cycle. The method further includes injecting a second charge of the liquid fuel into the cylinder using a second set of nozzle outlets in the fuel injector, such that spray jets of the second charge of liquid fuel are oriented at a relatively wider spray angle, and autoigniting the second charge of the liquid fuel such that the second charge of liquid fuel combusts by diffusion burning within the cylinder in a second engine cycle. The method still further includes transitioning operation of the engine from a relatively higher engine load in the first engine cycle to a relatively lower engine load in the second engine cycle, and decreasing fueling of the engine based on the transitioning of the operation of the engine, such that an amount of the second charge of liquid fuel is smaller than an amount of the first charge of liquid fuel.

DETAILED DESCRIPTION

Figure 1:
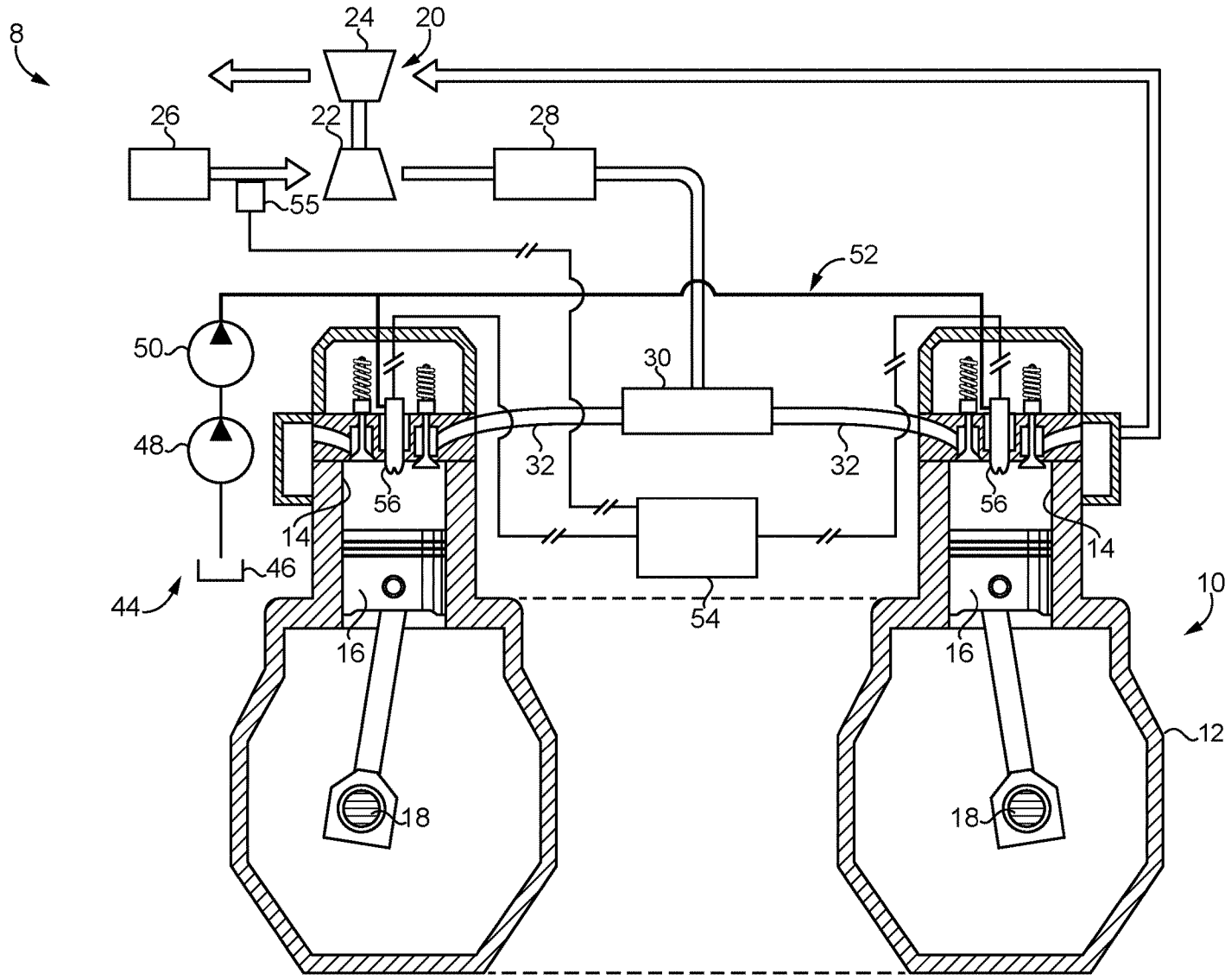
FIG. 1 is a partially sectioned side diagrammatic view of an internal combustion engine system, according to one embodiment.

Referring to FIG. 1, there is shown an internal combustion engine system 8 (hereinafter "engine system 8"), according to one embodiment. Engine system 8 can include a compression ignition internal combustion engine system structured to operate on liquid fuel. In an implementation, the liquid fuel can include diesel distillate fuel, however, other liquid hydrocarbon fuels such as biodiesel or blends might be used. Engine system 8 includes an internal combustion engine 10 having a housing 12 with a plurality of combustion cylinders 14 formed therein. Cylinders 14 can be of any number and in any suitable arrangement such as an in-line arrangement, a V-configuration, or still another arrangement. A piston 16 is movable within each one of combustion cylinders 14 to rotate a crankshaft 18 in a generally conventional manner. Engine system 8 can further include an intake conduit 26 structured to feed air for combustion to combustion cylinders 14 by way of a turbocharger 20 including a compressor 22 and a turbine 24. An aftercooler 28 is positioned downstream of compressor 22 and conveys cooled and compressed air to an intake manifold 30. A plurality of intake runners 32 extend between intake manifold 30 and each of combustion cylinders 14, again in a generally conventional manner. Engine system 8 further includes a fuel system 44.

Fuel system 44 includes a liquid fuel supply 46 such as a fuel tank, and can include at least one pump structured to convey the liquid fuel to engine 10. In the illustrated embodiment a low-pressure transfer pump 48 receives fuel from supply 46 and transitions the fuel to a high-pressure pump 50 that feeds a pressurized fuel reservoir 52 such as a common rail. Fuel reservoir and common rail are terms used interchangeably herein. For purposes of the present disclosure common rail 52 can be understood to itself be, or be a part of, a fuel supply. It should be appreciated that a single monolithic pressurized fuel reservoir could be used, as well as a plurality of separate pressure accumulators, or still another strategy such as a plurality of unit pumps. An electronic control unit 54 may be coupled with a plurality of liquid fuel injectors 56 of fuel system 44. A mass flow sensor 55 may be coupled with electronic control unit 54 to monitor incoming air flow for determining or estimating engine load indirectly, the significance of which will be further apparent from the following description. Liquid fuel injectors 56 may each be coupled with engine housing 12 and positioned so as to extend at least partially into each one of combustion cylinders 14. Each liquid fuel injector 56 can include twin or dual outlet checks, as further discussed herein, structured to inject liquid fuel in different quantities, at different spray angles or different spray patterns, for example, and for different purposes, including a first liquid fuel charge that serves as a main charge during operating engine 10 in a higher portion of its load range, and a second charge of liquid fuel that serves as a main charge during operating engine 10 in a lower portion of its load range. As will be further apparent from the following description, it is contemplated that separate control and separate design of the two outlet checks enables optimization for their different intended purposes.

Figure 2:
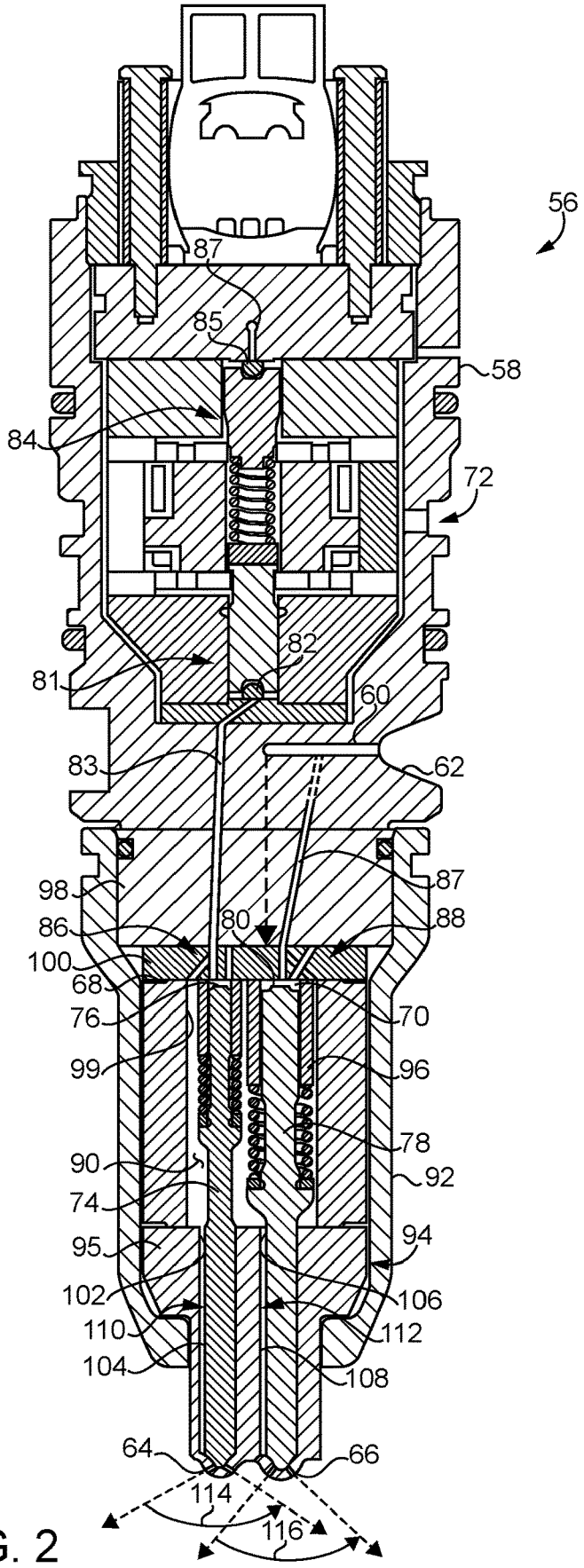
FIG. 2 is a sectioned side view of a fuel injector suitable for use in the internal combustion engine system of FIG. 1.

Referring also now to FIG. 2, there is shown a sectioned view through a liquid fuel injector 56 of a type suitable for use in engine system 8. Fuel injector 56 includes an injector body 58 defining a high-pressure inlet passage 60 connected with a high-pressure inlet 62. Inlet 62 may fluidly connect with reservoir/common rail 52, for example, by way of a so-called quill connector in one embodiment. Injector body 58 further defines a first set of nozzle outlets 64, a second set of nozzle outlets 66, a first control chamber 68, and a second control chamber 70 each fluidly connected to inlet passage 60. Injector body 58 also defines a low-pressure space 72 that can be a low-pressure outlet or drain, or multiple low-pressure outlets or drains, within injector body 58 or the space outside injector body 58. Fuel injector 56 further includes a first outlet check 74 having a closing hydraulic surface 76 exposed to a fluid pressure of first control chamber 68 and movable between a closed position blocking first set of nozzle outlets 64, and an open position. Fuel injector 56 also includes a second outlet check 78 having a closing hydraulic surface 80 exposed to a fluid pressure of second control chamber 70 and movable between a closed position blocking second set of nozzle outlets 66, and an open position. In the illustrated embodiment first outlet check 74 and second outlet check 78 are arranged side-by-side, and first set of nozzle outlets 64 has at least one of a spray angle, an outlet size, or an outlet number that is different from a spray angle, an outlet size or an outlet number of second set of nozzle outlets 66. First set of nozzle outlets 64 may form a narrower spray angle 114, and has a first combination of outlet number and outlet size, such that nozzle outlets 64 produce a greater steady flow of fuel for injection. Second set of nozzle outlets 66 may form a second, wider spray angle 116. Nozzle outlets 66 have a second combination of outlet size different from the first combination, such that nozzle outlets 66 produce a lesser steady flow of fuel for injection. Both of outlet number and outlet size may differ between the respective sets, although the present disclosure is not thereby limited, and only one of outlet number and outlet size might differ. Steady flow means a rate of flow that is observed if the same conditions are applied to/experienced by the respective nozzle outlet sets, irrespective of time. A greater number of outlets, a greater size of outlets, or both, can give a greater steady flow, whereas a lesser number of outlets, a lesser size of outlets, or both, results in a lesser steady flow.

Fuel injector 56 further includes a first electrically actuated injection control valve 82 in a first control valve assembly 81. Injection control valve 82 can be a first two-way injection control valve and is positioned fluidly between first control chamber 68 and low-pressure space 72. A control passage 83 extends between control valve assembly 81 and first control chamber 68. Control valve 82 is movable between a closed position blocking fluid communication between control passage 83 and low-pressure space 72 and an open position at which control passage 83 is fluidly connected to low-pressure space 72. Control valve 82 is thus structured to connect or disconnect a total of two passages. Fuel injector 56 also includes a second electrically actuated injection control valve 85 in a control valve assembly 84. Injection control valve 85 can be a second two-way injection control valve and is positioned fluidly between second control chamber 70 and low-pressure space 72. Instead of two-way injection control valves, three-way injection control valves, or still another valve configuration could be used. A control passage 87 extends between second control chamber 70 and control valve assembly 84. Control valve assembly 84 can function analogously to control valve assembly 81. In the illustrated embodiment each of control valve assembly 81 and control valve assembly 84 is a solenoid actuated control valve assembly structured to vary between a deenergized state where the respective control valves 82 and 85 are at their closed positions, and an energized state where control valves 82 and 85 move in opposition to a spring biasing force to an open position. Certain components are shared among control valve assembly 81 and control valve assembly 84, however, the present disclosure is not thereby limited. It can also be seen from FIG. 2 that control passage 83 and control passage 87 extend through a number of components of injector body 58, and may be out of plane in the view illustrated. Each of injection control valve 82 and injection control valve 85 can include a ball valve or a half-round, hemispheric valve structured to move into and out of contact with a flat valve seat, however, the present disclosure is not thereby limited. Those skilled in the art will be familiar with the design technique of providing for flow to low-pressure space 72 between or among the various components in injector body 58 between injection control valve assemblies 81 and 84 and low-pressure space 72 when injection control valves 82 and 85 are opened.

Injector body 58 further includes a casing 92 and a stack 94 positioned within casing 92. Injector body 58 also defines a common nozzle supply cavity 90 in fluid communication with inlet passage 60. Common nozzle supply cavity 90 can be understood as part of inlet passage 60, which in turn can be understood to extend from inlet 62 to each of nozzle outlets 64 and nozzle outlets 66. First set of nozzle outlets 64 and second set of nozzle outlets 66 are fluidly connected to common nozzle supply cavity 90 at the open position of first outlet check 74 and second outlet check 78, respectively. Common nozzle supply cavity 90 may be formed within stack 94, and each of first outlet check 74 and second outlet check 78 extends through common nozzle supply cavity 90. Stack 94 also includes a tip piece 95, positioned within casing 92 and having first set of nozzle outlets 64 and second set of nozzle outlets 66 formed therein. Tip piece 95 has therein a first guide bore 102 that receives first outlet check 74 and forms a first nozzle supply passage 104 with first outlet check 74. Tip piece 95 also has therein a second guide bore 106 that receives second outlet check 78 and forms a second nozzle supply passage 108 with second outlet check 78. A first M-orifice 110 is formed within tip piece 95 to limit flow through first nozzle supply passage 104. A second M-orifice 112 is formed within tip piece 95 to limit flow through second nozzle supply passage 108. A spacer 96, which can be cylindrical in shape, is positioned to abut tip piece 95 and includes a wall 99 extending circumferentially around first outlet check 74 and second outlet check 78 so as to form common nozzle supply cavity 90. Yet another stack piece 98 is positioned at least partially within casing 92, and an orifice plate 100 is sandwiched between stack piece 98 and spacer 96. Each of first outlet check 74 and second outlet check 78 can include opening hydraulic surfaces (not numbered) exposed to a fluid pressure of common nozzle supply cavity 90. Each of first outlet check 74 and second outlet check 78 is further biased closed by way of spring biasing in a generally known manner.

Figure 3:
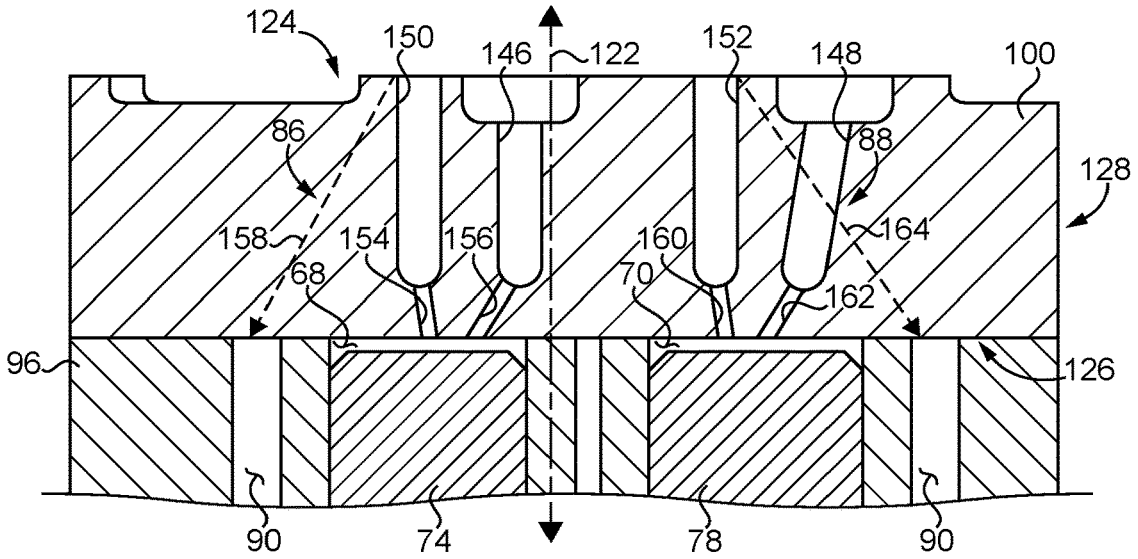
FIG. 3 is a sectioned view through an orifice plate taken along line 3-3 of FIG. 4, according to one embodiment.
Figure 4:
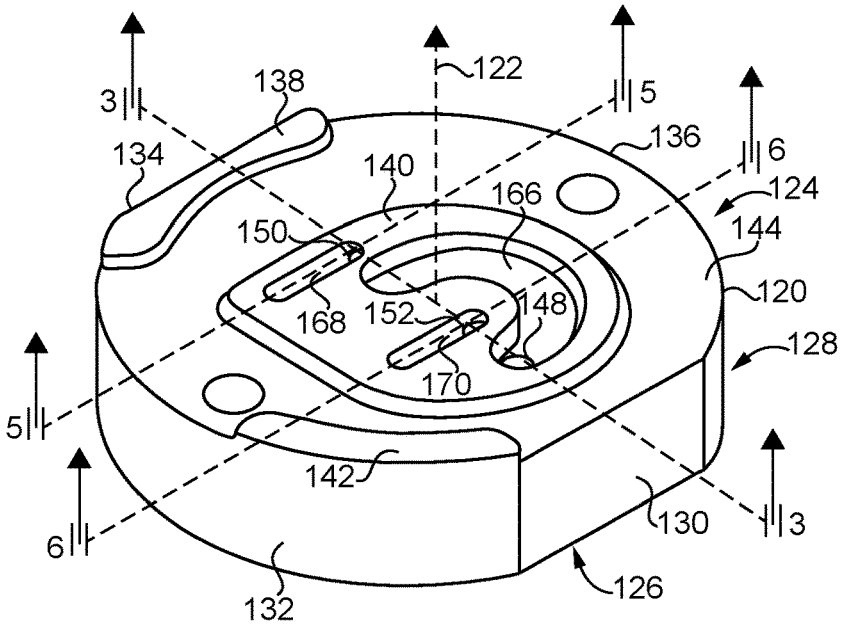
FIG. 4 is a perspective view of an orifice plate, according to one embodiment.

Injector body 58 still further defines a first set of orifices 86 arranged in an A-F-Z pattern among inlet passage 60, low-pressure space 72, and first control chamber 68. An "A" orifice is positioned fluidly between a check control chamber and an outlet to low pressure, whereas a "Z" orifice is fluidly between incoming high pressure and a check control chamber, and an "F" orifice fluidly connects a high pressure supply for the Z-orifice to an outlet of the A-orifice. A second set of orifices 88 is arranged in an A-F-Z pattern among inlet passage 60, low-pressure space 72, and second control chamber 70. Referring also now to FIGS. 3 and 4, there are shown additional details of orifice plate 100. Orifice plate 100 includes a one-piece orifice plate body 120 defining a center axis 122 extending between an upper plate body side 124 and a lower plate body side 126. Orifice plate body 120 also includes an outer peripheral edge 128 extending circumferentially around center axis 122. In the illustrated embodiment, outer peripheral edge 128 includes a first linear segment 130, a first arcuate segment 132, a second linear segment 134, and a second arcuate segment 136. First and second arcuate segments 132 and 136 are in an alternating arrangement with first and second linear segments 130 and 134. Orifice plate body 120 also has a plurality of raised sealing surfaces including a first raised sealing surface 138, a second raised sealing surface 140, and a third raised sealing surface 142. It can be seen from FIG. 4 that sealing surface 138 and sealing surface 142 are arranged adjacent to first arcuate segment 132 and second linear segment 134, respectively. Orifice plate body 120 also includes a recessed surface 144 positioned axially inward of raised sealing surfaces 138, 140, and 142. Orifice plate body 120 further has a first inlet passage 146 and a second inlet passage 148 extending between upper plate body side 124 and lower plate body side 126, for feeding high-pressure fuel to first control chamber 68 for first outlet check 74 and second control chamber 70 for second outlet check 78, respectively.

Orifice plate body 120 also includes a first outlet passage 150 and a second outlet passage 152 extending between lower plate body side 126 and upper plate body side 124, for connecting first and second control chambers 68 and 70 to low-pressure space 72. First set of orifices 86 in orifice plate body 120 is also shown in FIG. 3 and include a first A-orifice 154 formed in first outlet passage 150, a first Z-orifice 156 formed in first inlet passage 146, and a first F-orifice 158. F-orifice 158 is out of plane in FIG. 3, but described and illustrated elsewhere hereinafter. Second set of orifices 88 in orifice plate body 120 is also shown in FIG. 3 and includes a second A-orifice 160 formed in second outlet passage 152, a second Z-orifice 162 formed in second inlet passage 148, and a second F-orifice 164. First and second F-orifices 158 and 164 fluidly connect first and second outlet passages 150 and 152 to lower plate body side 126 to fluidly connect common nozzle supply cavity 90 in fuel injector 56 to each of first and second control chambers 68 and 70. Provision of F-orifices 158 and 164 assists in refilling of control chambers 68 and 70 at the end of fuel injection, as further discussed herein. It should be appreciated that F-orifices 158 and 164 could connect to high-pressure inlet passage 60 by another architecture. In other words, in a practical implementation strategy F-orifices 158 and 164 connect to common nozzle supply cavity 90, but could be configured otherwise without departing from the scope of the present disclosure. The various orifices described herein could also be positioned in components of stack 94 other than orifice plate 100 in other embodiments.

It can also be noted from FIG. 4 that a first connector channel 166 is formed in upper plate body side 124 and fluidly connects first inlet passage 146 to second inlet passage 148. First connector channel 166 may have a C-shaped configuration, although the present disclosure is not thereby limited. A second connector channel 168 is formed in upper plate body side 124 and fluidly connects first outlet passage 150 to first F-orifice 158. A third connector channel 170 is formed in upper plate body side 124 and fluidly connects first outlet passage 150 to second F-orifice 164. Each of second connector channel 168 and third connector channel 170 may be linear in shape. It can also be noted that each of first, second, and third connector channels 166, 168, and 170 is formed in raised sealing surface 140. The axial depth between raised sealing surfaces 138, 140, and 142 and recessed surface 144 can provide a space that is connected to high pressure when fuel injector 56 is assembled for service. First and second inlet passages 146 and 148 and first and second outlet passages 150 and 152 may be in an alternating arrangement between first and second linear segments 130 and 134 of outer peripheral edge 128.

Figure 5:
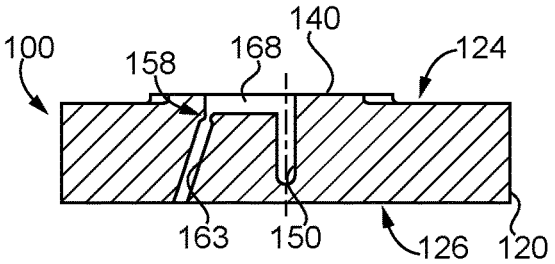
FIG. 5 is a sectioned view taken along line 5-5 of FIG. 4.
Figure 6:
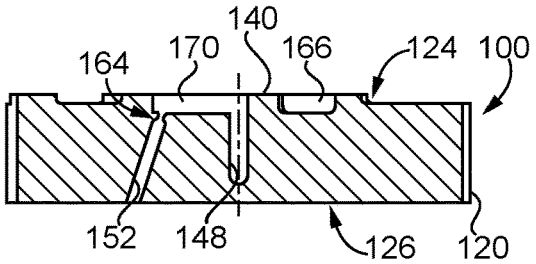
FIG. 6 is a sectioned view taken along line 6-6 of FIG. 4.

Referring also now to FIG. 5 and FIG. 6, there are shown sectioned views taken along lines 5-5 and 6-6 of FIG. 4. It will also be noted that the sectioned view in FIG. 3 includes subject matter of orifice plate 100 taken along line 3-3 of FIG. 4. It can be seen from FIG. 5 and FIG. 6 that F-orifices 158 and 164 each extend at an angle from the corresponding connector channel 168 and 170, relative to center axis 122. It will be recalled that F-orifices 158 and 164 provide fluid connections between outlet passages 150 and 152 and common nozzle supply cavity 90. A first fluid passage 163 extends between upper plate body side 124 and lower plate body side 126, and a second fluid passage 152 also extends between upper plate body side 124 and lower plate body side 126. First fluid passage 163 includes first F-orifice 158 and opens at lower plate body side 126, whereas second fluid passage 152 includes second F-orifice 160 and opens at lower plate body side 126. It can also be noted from FIG. 35 that each of first and second A-orifices 154 and 160 and each of first and second Z-orifices 156 and 162 is formed adjacent to lower plate body side 126. Each of first and second F-orifices 156 and 158 can be formed adjacent to upper plate body side 124. Sizes of each of the A, F, and Z-orifices herein may be within an order of magnitude of one another.

Figure 7:
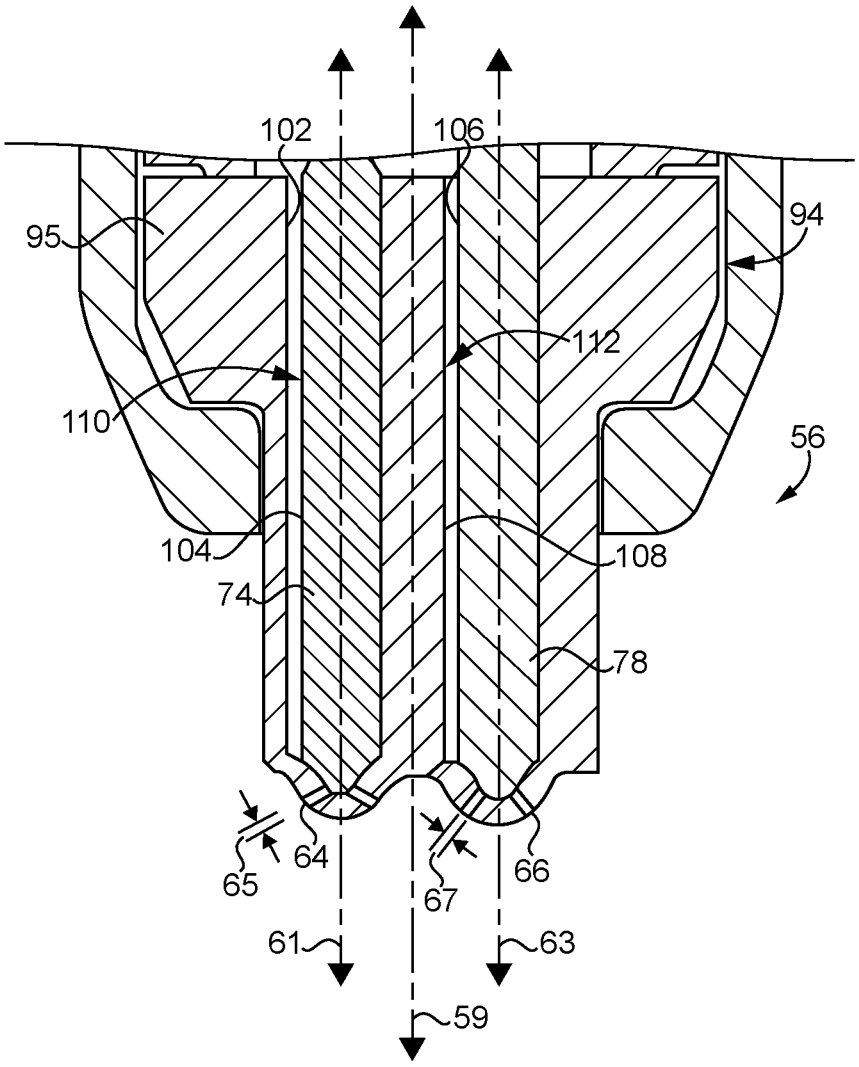
FIG. 7 is an enlarged sectioned view of a portion of a liquid fuel injector, according to one embodiment.

Referring also now to FIG. 7, there is shown a close-up view of a portion of fuel injector 56, illustrating side-by-side arrangement of outlet check 74 and outlet check 78. Outlet check 74 and outlet check 78 are shown in closed positions and structured to lift and return along a first check axis 61 and a second check axis 63, respectively, with axes 61 and 63 being parallel to one another and parallel to a longitudinal axis 59 of fuel injector 56 itself. In one example configuration, nozzle outlets 66 are straight and substantially cylindrical, from 6 to 8 in number, and have a hole diameter 67 that is about 300 microns or 0.003 millimeters. Nozzle outlets 66 may be arranged circumferentially about axis 63, have uniform orientations at the subject spray angle and may be evenly spaced from one another. Nozzle outlets 64 might also be straight and substantially cylindrical, be from 4 to 6 in number, and have a hole diameter 65 that is from about 25% to about 50% of hole diameter 67. In one implementation hole diameter 65 is 150 microns or 0.0015 millimeters. Nozzle outlets 64 may be circumferentially and uniformly spaced about axis 61, and have uniform orientations at the subject spray angle. Spray angle 116 may be from about 130° to about 140°, and spray angle 114 from about 140° to about 150°. As used herein, the term "about" can be understood in the context of conventional rounding to a consistent number of significant digits. Thus, "about 300" is from 250 to 349, "about 25%" is from 24.5% to 25.4%, and so on.

Figure 8:
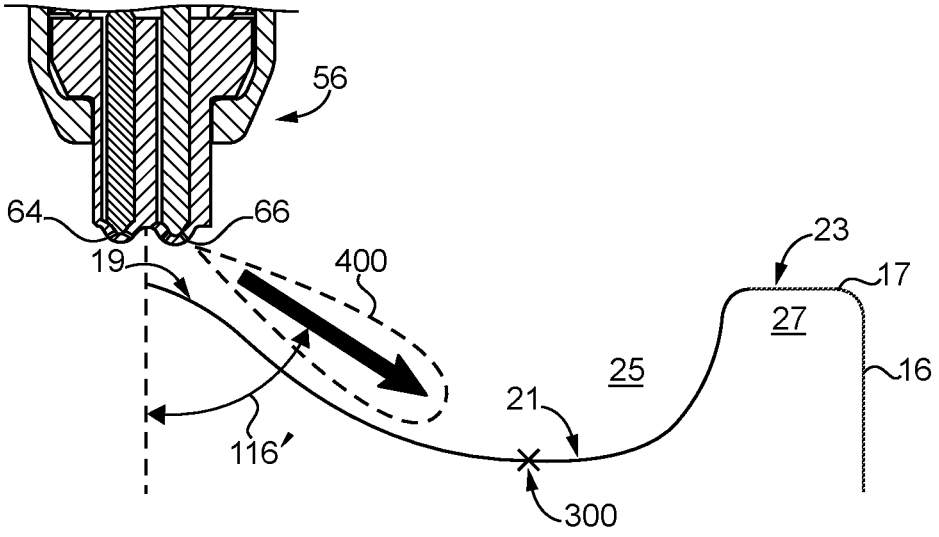
FIG. 8 is a diagrammatic view of liquid fuel injection, and associated apparatus at a first set of conditions.
Figure 9:
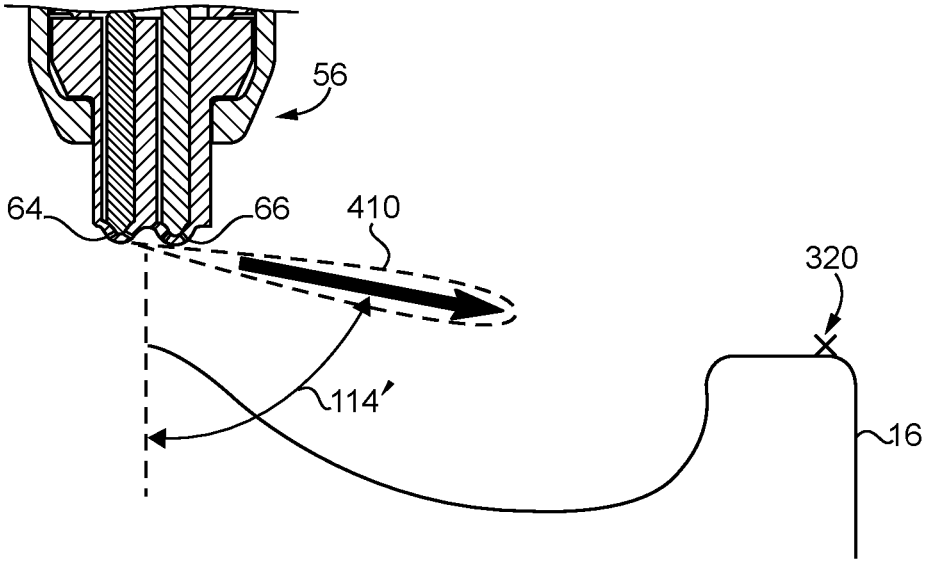
FIG. 9 is a diagrammatic view of liquid fuel injection, and associated apparatus at another set of conditions.

Referring also now to FIG. 8, spray jets of liquid fuel, in the context of the present description the first charge of liquid fuel, may be targeted along a surface of a combustion bowl in a piston within the corresponding cylinder. In FIG. 8 piston 16 is shown, illustrating a piston top surface 17 that has a middle or inner convex section 19, an outer rim section 23 that forms a piston rim 27, and a concave bowl section 21 extending between section 19 and section 17 and forming a combustion bowl 25. A fuel spray jet is shown at 400 with an arrow indicating an approximate direction of targeting of fuel spray jet 400 toward a target 300 approximately in the middle or close to the lowest point of combustion bowl 25. Different combustion strategies and objectives might have substantially different targets, which could be constant for a given engine or class of engines, or change depending upon a presently desired or required outcome. In other words, the targeting could be varied cycle to cycle. It will be understood that piston 16 is reciprocating up and down within the corresponding cylinder 14, such that a position of piston 16 relative to spray jet 400 can vary with varying engine speed or varying velocity of spray jet 400 as it advances through cylinder 14. A velocity of spray jet 400 can depend upon injection pressure, including injection pressure relative to an internal pressure and/or density of fluid within cylinder 14. Thus, a density of fluids within cylinder 14, including air and potentially gaseous fuel and/or recirculated exhaust gas, can affect the speed and extent of penetration of spray jets of injected liquid fuel. It will therefore be appreciated that turbocharger boost pressure, engine speed, and injection timing and amount can all bear upon the manner in which fuel spray jets advance through an engine cylinder. To obtain desired combustion results, engineers typically target certain features within an engine cylinder as noted above. In the illustration of FIG. 8, spray jet 400 is targeted along surface 17, in particular along the portions of surface 17 forming combustion bowl 25, toward target 300. In at least some instances fuel injection design properties can be based on a 100% load or rated condition. For operation in a higher portion of an available engine load range, such as 50%-100% load, it can be desirable to limit entrainment of air into fuel spray jets to obtain a desired balance between production of oxides of nitrogen, or NOx, and soot. Spray angle 116', shown relative to a cylinder centerline, may be about 65°. Referring also to FIG. 9, there is shown fuel injector 56 positioned in proximity to piston 16, with a fuel spray jet 410 shown directed from nozzle outlets 64 toward a different target 320. A spray angle 114' relative to the cylinder centerline may be about 75°. At lower load conditions, such as less than 50% load, production of NOx may be of less concern, and it is thus desirable to entrain more air to promote more complete burning and minimize soot.

Industrial Applicability

Referring to the drawings generally, during operating engine system 8 outlet check 78 can be controlled by way of injection control valve assembly 84 to open and close to inject a first charge of liquid diesel fuel into cylinder 14 in an engine cycle, using nozzle outlets 66 such that spray jets of the first charge of liquid fuel are oriented at relatively narrower spray angle 116. The first charge can be autoignited within cylinder 14 such that the first charge combusts by diffusion burning within cylinder 14 in the first engine cycle. Embodiments are also contemplated wherein both of second outlet check 78 and first outlet check 74 are operated by way of control valve assembly 84 and control valve assembly 81, respectively, to cooperate in injection of a charge of liquid diesel fuel, provide successive injections within the same engine cycle, such as pilot injections, pre-injections, or post-injections. Injection control valve assembly 84 can be energized to lift injection control valve 85 from its seat to cause a drop in pressure in second control chamber 70, in turn enabling pressure acting on opening hydraulic surfaces of outlet check 78 in common nozzle supply cavity 90 to lift outlet check 78 to open nozzle outlets 66. When injection is to be ended, or just prior to when injection is to be ended, injection control valve assembly 84 is deenergized, to close injection control valve 85 and enable pressure to increase in second control chamber 70 and act upon closing hydraulic surface 80 to cause outlet check 78 to close. Piston 16 moves in a conventional four-phase cycle to intake, compress, combust, and exhaust the mixture of air and diesel fuel. As noted above, outlet check 74 can be operated generally analogously to operation of outlet check 78 so as to inject a second charge of liquid diesel fuel into cylinder 14 using nozzle outlets 66, such that spray jets of the second charge of liquid fuel are oriented at a relatively wider spray angle. The second charge is autoignited in a manner generally analogous to that of the first charge.

Operation of engine 10 may be transitioned from a relatively higher engine load in the first engine cycle to a relatively lower engine load in the second engine cycle. Operation of engine 10 can of course be transitioned in the reverse, from one engine cycle where engine load is relatively lower to another engine cycle where engine load is relatively higher. Data produced by sensor 55 enables electronic control unit 54 to determine or estimate a present engine load and changes in engine load. In one implementation, transitioning of the operation of engine 10 includes transitioning from greater than a 50% load to less than a 50% load, using nozzle outlets 66 when engine 10 is operated at greater than 50% load and using nozzle outlets 64 when engine 10 is operated at less than 50% load. Other operating strategies could transition between the use of the respective sets of nozzle outlets at load thresholds other than 50%. In still other instances, a threshold for transitioning between use of nozzle outlets 64 and nozzle outlets 66 could vary cycle to cycle based upon factors such as engine speed, boost pressure, or still others. Fueling of engine 10 may be decreased based on the transitioning of the operation of engine 10, such that an amount of the second charge of liquid fuel is smaller than an amount of the first charge of liquid fuel. Analogously, when operation of engine 10 is transitioned from a lower load to a higher load, fueling of engine 10 may be increased.

As noted above, employing dual outlet checks can enable separation of design of each outlet check for different purposes, namely, different injection characteristics at different parts of an engine load range. A liquid fuel charge during lower load operation may be injected at a relatively shallower angle, whereas a charge for higher load operation can be injected at a somewhat deeper angle into cylinder 14 as discussed herein. It is believed that the deeper/narrower angle during higher load operation enables spray jets to somewhat limit entrainment of air such that NOx production is limited, and also to reduce risk of the spray jets impinging upon a cylinder liner. At lower load operation some of the constraints as to NOx production and liner impingement are relaxed.

It will also be recalled that orifice sets 86 and 88 affect the nature of fuel injection, and can be sized to various ends. F-orifices can be employed to slow a rate of pressure drop in the control chambers when connected to low pressure, and can hasten the rate of pressure build at the end of injection. As a result, the F-orifices can assist in obtaining a relatively square rate shape to an end of injection, or tailored to obtain another rate shape. Z-orifices can analogously assist in obtaining a relatively square end of injection shape, for example. Varying a size of a Z-orifice within the present context tends to have a relatively larger effect on end-of-injection properties than varying the size of an F-orifice. The M-orifices are controlled clearances around the outlet checks that act to retard the start of injection. The A-orifices also tend to affect start of injection, assisting in controlling spilling of pressure from the associated control chamber.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

The invention claimed is:

1. A liquid fuel injector for an internal combustion engine comprising:

an injector body defining an inlet passage, a first set of nozzle outlets, a second set of nozzle outlets, a first control chamber and a second control chamber each in fluid communication with the inlet passage, and a low pressure space;

a first outlet check having a closing hydraulic surface exposed to a fluid pressure of the first control chamber and movable between a closed position blocking the first set of nozzle outlets, and an open position;

a second outlet check having a closing hydraulic surface exposed to a fluid pressure of the second control chamber and movable between a closed position blocking the second set of nozzle outlets, and an open position;

a first injection control valve positioned fluidly between the first control chamber and the low pressure space;

a second injection control valve positioned fluidly between the second control chamber and the low pressure space;

the first set of nozzle outlets forming a narrower spray angle, from about 130 degrees to about 140 degrees, and having a first combination of outlet number and outlet size, such that the first set of nozzle outlets produces a relatively greater steady flow of fuel for injection;

the second set of nozzle outlets forming a wider spray angle, from about 140 degrees to about 150 degrees, and having a second combination of outlet number and outlet size different from the first combination, such that the second set of nozzle outlets produces a relatively lesser steady flow of fuel for injection; and the injector body further defining a common nozzle supply cavity in fluid communication with the inlet passage, and the first set of nozzle outlets and the second set of nozzle outlets being in fluid communication with the common nozzle supply cavity at the open positions of the first outlet check and the second outlet check, respectively.

2. The liquid fuel injector of claim 1 wherein each of the first injection control valve and the second injection control valve includes a two-way valve.

3. The liquid fuel injector of claim 1 wherein the first combination of outlet number and outlet size includes a first outlet number and a first outlet size, and the second combination of outlet number and outlet size includes a second outlet number and a second outlet size that are different from the first outlet number and the first outlet size.

4. The liquid fuel injector of claim 3 wherein:

the first set of nozzle outlets has an outlet number from 6 to 8 and the second set of nozzle outlets has an outlet number from 4 to 6;

the first set of nozzle outlets has an outlet size that includes a first hole diameter and the second set of nozzle outlets has an outlet size that includes a second hole diameter; and the second hole diameter is from about 25% to about 50% of the first hole diameter.

5. The liquid fuel injector of claim 4 wherein the first hole diameter is about 0.0030 millimeters, and the second hole diameter is about 0.0015 millimeters.

6. The liquid fuel injector of claim 1 wherein the injector body defines a first set of orifices arranged in an A-F-Z pattern among the inlet passage, the low pressure space, and the first control chamber, and a second set of orifices arranged in an A-F-Z pattern among the inlet passage, the low pressure space, and the second control chamber.

7. The liquid fuel injector of claim 6 wherein the injector body includes a casing and a stack positioned within the casing, and wherein the common nozzle supply cavity is formed within the stack and each of the first outlet check and the second outlet check extends through the common nozzle supply cavity.

8. The liquid fuel injector of claim 7 wherein the stack includes an orifice plate, and wherein the first set of orifices includes a first F-orifice and the second set of orifices includes a second F-orifice, and each of the first F-orifice and the second F-orifice is formed in a fluid passage in the orifice plate that opens to the common nozzle supply cavity.

9. A fuel system for an internal combustion engine comprising:

a liquid fuel supply;

a plurality of liquid fuel injectors each defining an inlet passage, a first set of nozzle outlets, a second set of nozzle outlets, and a low pressure space;

the plurality of liquid fuel injectors each including a first direct-operated outlet check movable between a closed position blocking the first set of nozzle outlets, and an open position, and a second direct-operated outlet check movable between a closed position blocking the second set of nozzle outlets, and an open position;

the plurality of liquid fuel injectors each further including a first injection control valve coupled with the first direct-operated outlet check, and a second injection control valve coupled with the second direct-operated outlet check;

the first set of nozzle outlets in each one of the plurality of liquid fuel injectors forming a narrower spray angle, from about 130 degrees to about 140 degrees, and having a first combination of outlet number and outlet size, such that the first set of nozzle outlets produces a greater steady flow of fuel for injection; and the second set of nozzle outlets in each one of the plurality of liquid fuel injectors forming a wider spray angle, from about 140 degrees to about 150 degrees, and having a second combination of outlet number and outlet size different from the first combination, such that the second set of nozzle outlets produces a lesser steady flow of fuel for injection.

10. The fuel system of claim 9 wherein:

the liquid fuel supply includes a pressurized fuel reservoir, and each of the plurality of liquid fuel injectors has a common nozzle supply cavity formed therein that is in fluid communication with the pressurized fuel reservoir by way of the inlet passage; and the common nozzle supply cavity is in fluid communication with the first and the second sets of nozzle outlets at the open positions of the corresponding first and second direct-operated outlet check.

11. The fuel system of claim 10 wherein each of the plurality of liquid fuel injectors further defines a first control chamber and a second control chamber for the first and the second direct-operated outlet check, respectively, and defines a first set of orifices arranged in an A-F-Z pattern among the inlet passage, the low pressure space, and the first control chamber, and a second set of orifices arranged in an A-F-Z pattern among the inlet passage, the low pressure space, and the second control chamber.

12. The fuel system of claim 9 wherein the first and the second direct-operated outlet checks are arranged side-by-side.

13. The fuel system of claim 12 wherein the first combination of outlet number and outlet size includes a first outlet number and a first outlet size, and the second combination of outlet number and outlet size includes a second outlet number and a second outlet size.

14. The fuel system of claim 13 wherein the first set of nozzle outlets has an outlet number from 6 to 8 and the second set of nozzle outlets has an outlet number from 4 to 6.

15. The fuel system of claim 14 wherein the first set of nozzle outlets has an outlet size that includes a first hole diameter and the second set of nozzle outlets has an outlet size that includes a second hole diameter, and wherein the second hole diameter is from about 25% to about 50% of the first hole diameter.

16. The fuel system of claim 15 wherein the first hole diameter is about 0.0030 millimeters, and the second hole diameter of about 0.0015 millimeters.

17. A method of operating an engine comprising:

supplying a liquid fuel to a liquid fuel injector positioned at least partially within a cylinder in the engine;

injecting a first charge of the liquid fuel into a cylinder in the engine using a first set of nozzle outlets in a fuel injector, such that spray jets of the first charge of liquid fuel are oriented at a relatively narrower spray angle;

autoigniting the first charge of the liquid fuel such that the first charge of liquid fuel combusts by diffusion burning within the cylinder in a first engine cycle;

injecting a second charge of the liquid fuel into the cylinder using a second set of nozzle outlets in the fuel injector such that spray jets of the second charge of the liquid fuel are oriented at a relatively wider spray angle;

autoigniting the second charge of the liquid fuel such that the second charge of the liquid fuel combusts by diffusion burning within the cylinder in a second engine cycle;

transitioning operation of the engine from a relatively higher engine load in the first engine cycle to a relatively lower engine load in the second engine cycle;

decreasing fueling of the engine based on the transitioning of the operation of the engine, such that an amount of the second charge of the liquid fuel is smaller than an amount of the first charge of the liquid fuel;

targeting, based on the relatively narrower spray angle, the first charge of liquid fuel at a first target in the cylinder relative to a piston, for entrainment of relatively less air; and targeting, based on the relatively wider spray angle, the second charge of liquid fuel at a second, different target in the cylinder relative to the piston, for entrainment of relatively more air.

18. The method of claim 17 wherein:

the supplying of the liquid fuel further includes supplying the liquid fuel from a pressurized fuel reservoir to a common nozzle supply passage in the fuel injector; and the injecting of the first charge of the liquid fuel and the injecting of the second charge of liquid fuel each include supplying the liquid fuel for injection to the first and the second sets of nozzle outlets from the common nozzle supply cavity.

19. The method of claim 18 wherein the first set of nozzle outlets has a first combination of outlet number and outlet size, and the second set of nozzle outlets has a second combination of outlet number and outlet size different from the first combination.

* * * * *